US006952838B1

(12) United States Patent
Gillette

(10) Patent No.: US 6,952,838 B1
(45) Date of Patent: Oct. 11, 2005

(54) ADJUSTABLE SUN GLOVE

(75) Inventor: Elise Marina Jacqueline Gillette, 903 E. Moorhead Cir. #2L, Boulder, CO (US) 80305

(73) Assignee: Elise Marina Jacqueline Gillette, Niwet, CO (US)

( * ) Notice: Subject to any disclaimer, the term of this patent is extended or adjusted under 35 U.S.C. 154(b) by 0 days.

(21) Appl. No.: 10/938,896

(22) Filed: Sep. 11, 2004

Related U.S. Application Data

(60) Provisional application No. 60/503,301, filed on Sep. 16, 2003.

(51) Int. Cl.[7] ..... A41D 19/00
(52) U.S. Cl. ..... 2/159; 2/160
(58) Field of Search ..... 2/16, 159

(56) References Cited

U.S. PATENT DOCUMENTS 1,117,077 A * 11/1914 Mooney ..... 2/16
1,883,062 A * 10/1932 Steinberger ..... 2/159
2,443,938 A * 6/1948 Vernon ..... 2/159
4,297,746 A * 11/1981 Zarbos ..... 2/108
4,773,100 A * 9/1988 Kuo ..... 2/46
4,785,478 A 11/1988 Mosley
5,056,157 A 10/1991 Pryor
5,357,633 A * 10/1994 Rael ..... 2/16
5,435,012 A 7/1995 Lincoln
5,617,583 A * 4/1997 Yates et al. ..... 2/160
5,924,130 A * 7/1999 Fragomeli ..... 2/16
6,029,278 A * 2/2000 Lopez ..... 2/209.13
6,240,565 B1 * 6/2001 Spear ..... 2/158
6,539,550 B1 4/2003 Flores

* cited by examiner

*Primary Examiner*—John J. Calvert
*Assistant Examiner*—Andrew W. Sutton

(57) ABSTRACT

A sun glove (10) design for providing adjustability of the sleeve length (11). The preferred embodiment comprises a fabric casing sleeve (26), made of UV protective fabric, that can hold the gathered sleeve (11). The rest of the glove is made of UV protective fabric also, but may be different from the sleeve extension fabric. When the sleeve extension (11) covers the user's (12) upper extremity (14), the fabric casing sleeve (26) is empty and drapes over the sleeve, while still looking fashionable. A user of the adjustable sun glove (10) can increase or decrease the length of the sleeve extension (11), thereby providing more or less coverage on their upper extremities (14) as desired. Thus a considerably more versatile sun glove (10) is provided that can be adjusted to provide varying lengths, hence varying upper extremity (14) coverage.

13 Claims, 5 Drawing Sheets

Figure 1:
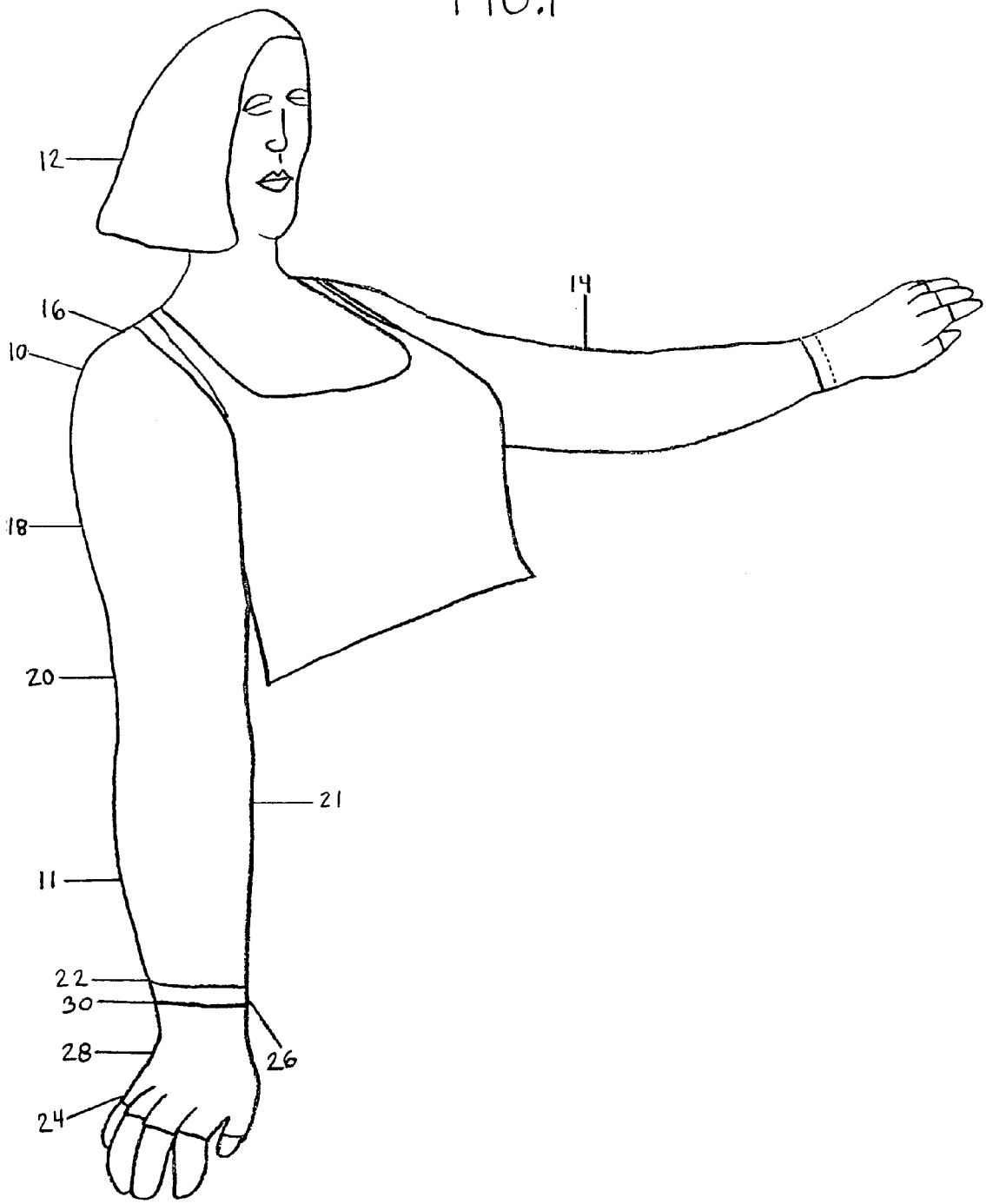

FIG. 2A
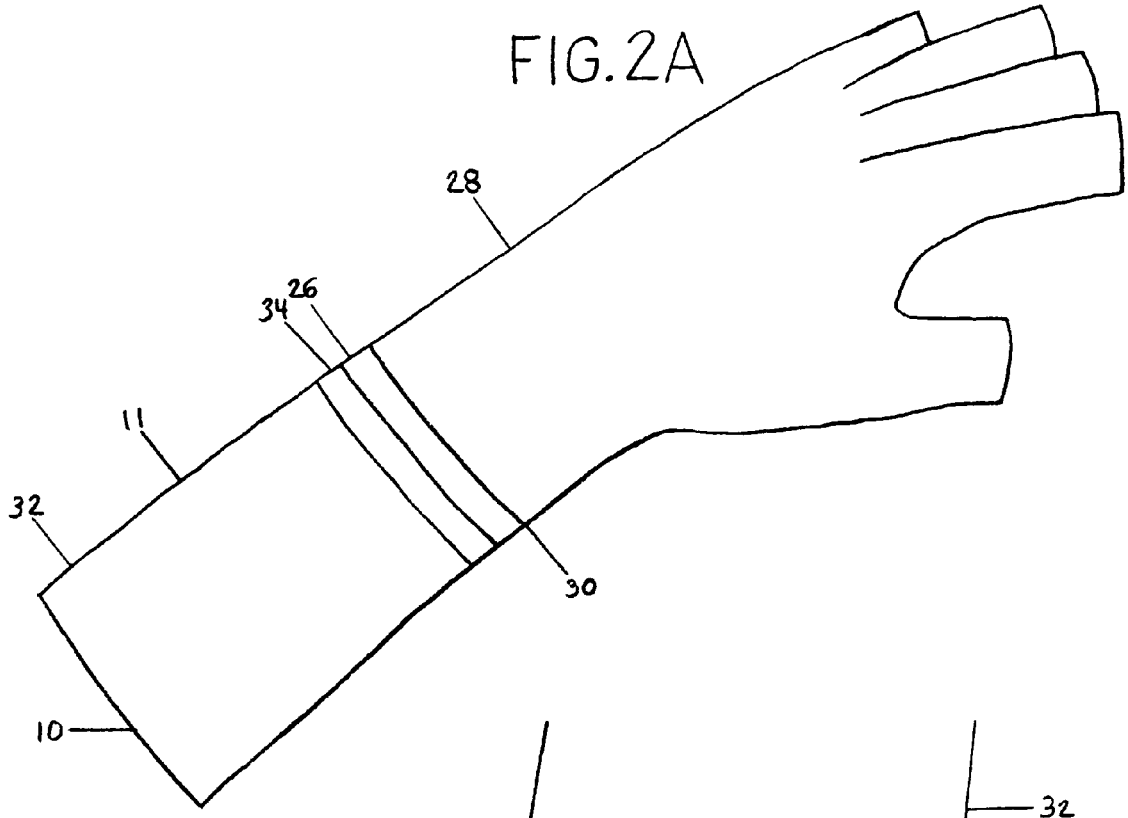
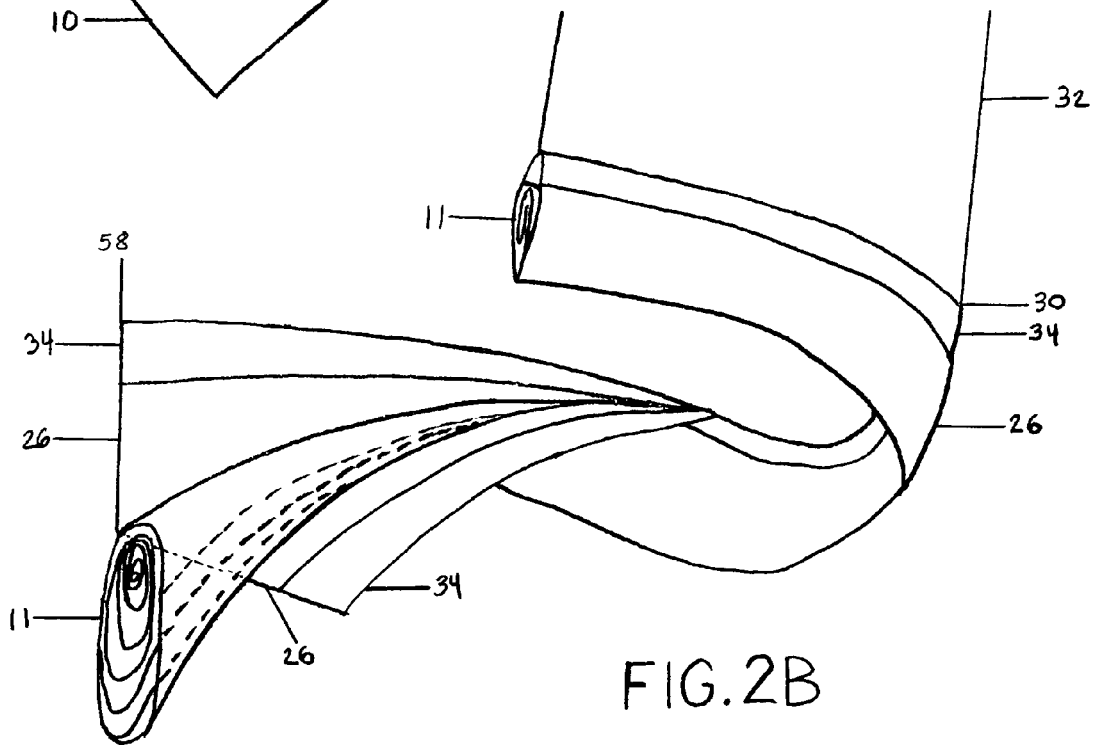
FIG. 2B

ADJUSTABLE SUN GLOVE

CROSS REFERENCE TO RELATED APPLICATION

This application claims the benefit of PPA Ser. No. 60/503,301, filed 2003 Sep. 16 by the present inventor.

FEDERALLY SPONSORED RESEARCH

None

SEQUENCE LISTING

None

BACKGROUND OF THE INVENTION

1. Field of Invention

This invention relates to gloves, specifically to such gloves used to protect a person's upper extremities from the sun.

2. Background of the Invention

While performing activities of daily living (ADLs) it is desirable to protect ones upper extremities (hands, forearms, elbows, upper arms, shoulders) from the sun's harmful rays. When one lives in a warm and sunny climate it is common for a person's skin to be exposed to the sun while sitting in ones car (even with window closed) or pushing a shopping cart in the grocery store parking lot, for example. This exposure can be harmful.

Wearing gloves in a warm and sunny climate is not an appealing idea as adding a layer to one's skin can further increase an already warm body temperature. This can be an uncomfortable set-up. The person may sweat and feel too hot overall.

Thus there exists a need for a glove with adjustable coverage so that the wearer can choose the appropriate length according to the amount of coverage they desire at the moment. Various factors affect what length a wearer wants. Some of these factors are temperature, coverage sought, fashion choice, and/or comfort.

Inventors have created several types of sun covers for hands and arms. U.S. Pat. No. 6,539,550 to Flores (2003) discloses a set of three driving gloves, each of varying length. However, the wearer must change gloves to alter glove length. This is an inconvenient situation since the person must carry three pairs of gloves around and then must go through the process of changing gloves. The aforementioned gloves are intended for driving, but to be safe on the road, the driver would need to stop driving to change the gloves.

Mosley, in U.S. Pat. No. 4,785,478 (1988) shows a hand covering intended to provide sun protection. This glove does not provide for coverage beyond the hand and therefore does not include adjusting coverage of the upper extremity at all. Mosley's glove does not provide coverage for the palm. Mosley claims that not exposing the bottom of the hand can be a detriment to performance of operations requiring manual dexterity. While the effectiveness of grip is debatable, one thing is certain: Mosley's glove does not address improving grip beyond what it would be without the use of gloves.

Another sun-shielding glove is shown in Lincoln's U.S. Pat. No. 5,435,012 (1995). It is intended to shield the backs of the hands from sunlight. Ventilation is provided by slits on sides of the hand and bands and strips that encircle the digits and wrist as well as string netting. Such a design may provide air flow to the hand but my be impractical to put on and wear. It may take a long time to don the gloves. The bands, straps, and string netting may not be elegant, but cumbersome instead, and the person will be less likely to want to wear them other than when they are not trying to look fashionable. Also, Lincoln's gloves provide for fabric over the ends of the fingers reducing the potential for hand dexterity and sensitivity.

Like Mosley's gloves, Lincolns' do not address improving grip beyond what the grip could be without the use of gloves. Furthermore, it is possible that with numerous straps and bands fitted on sweaty skin sores may develop. It has been shown that when moist skin has pressure and shearing forces applied to it, pressure wounds develop. When a person is gripping an object this will apply pressure and shearing to the moist skin, this will leave the skin vulnerable to trauma, especially at the points where the fabric stops and pinching may also occur to the skin.

Like Flores' and Mosley's gloves, Lincoln's devices are not length adjustable.

U.S. Pat. No. 5,056,157 to Pryor (1991) depicts a solar radiation protecting device for the forearm and a portion of the upper arm. It allows for ventilation by leaving the bottom portion bare except for some securing straps. However, it does not provide for hand nor shoulder coverage. The length of the device is not adjustable either. It is intended for use only when driving as opposed to performing any activity of daily living.

OBJECTS AND ADVANTAGES

Accordingly, several objects and advantages of my invention are:

(a) to provide an upper extremity sun cover whose length can be adjusted (b) to provide an upper extremity sun cover whose length can be adjusted without removing it (c) to provide an upper extremity sun cover that can protect the shoulders (d) to provide a sun glove with a palm grip surface that enhances grip ability for activities of daily living (e) to provide a sun glove with a palm grip surface that protects structures that are commonly injured in the hand (f) to provide a glove that can allow for exposure of accessories through the glove (g) to provide a sun glove designed to be worn on any occasion from driving off for one's honeymoon after one's wedding to when grocery shopping or hiking Still further objects and advantages will become apparent from consideration of the ensuing description and drawings.

SUMMARY

The invention, an improved sun glove, has adjustable proximal sleeve extension. The user can alter the length of the sun shielding device, tailoring the amount that the upper extremity is to be covered according to the user's needs. Since the length of the glove can be changed, the user need not change gloves to change coverage. Also, these gloves are intended for use with everyday activities and/or on special occasions. The palm surface has grip enhancing material on it thereby improving grip.

DRAWINGS—FIGURES

Figure 3A:
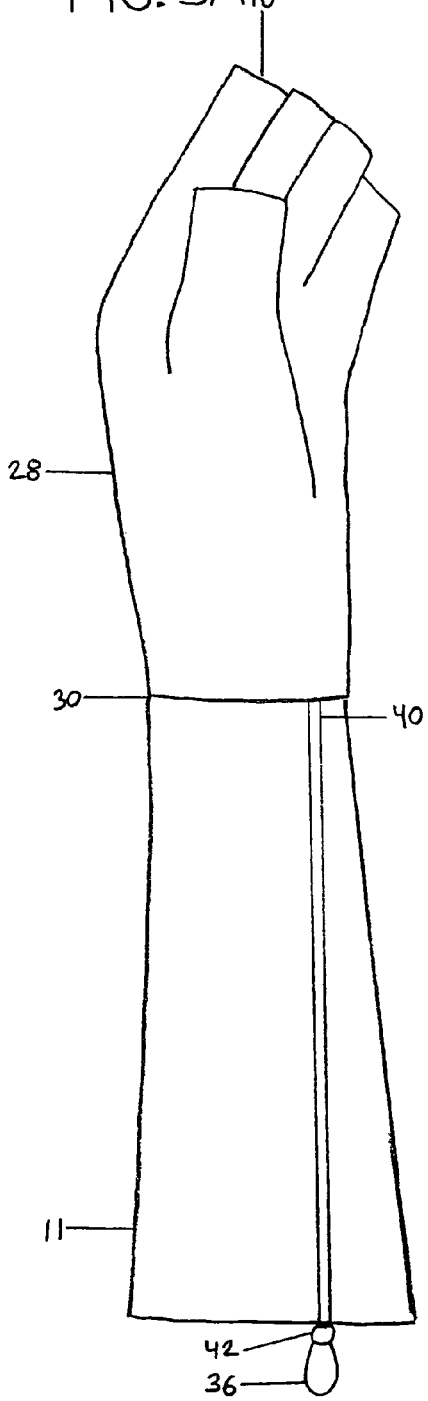
Figure 3B:
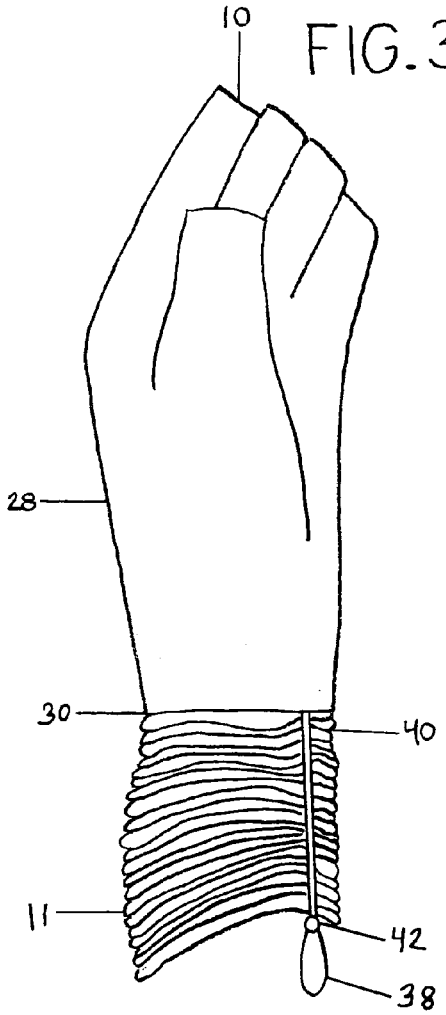
Figure 4A:
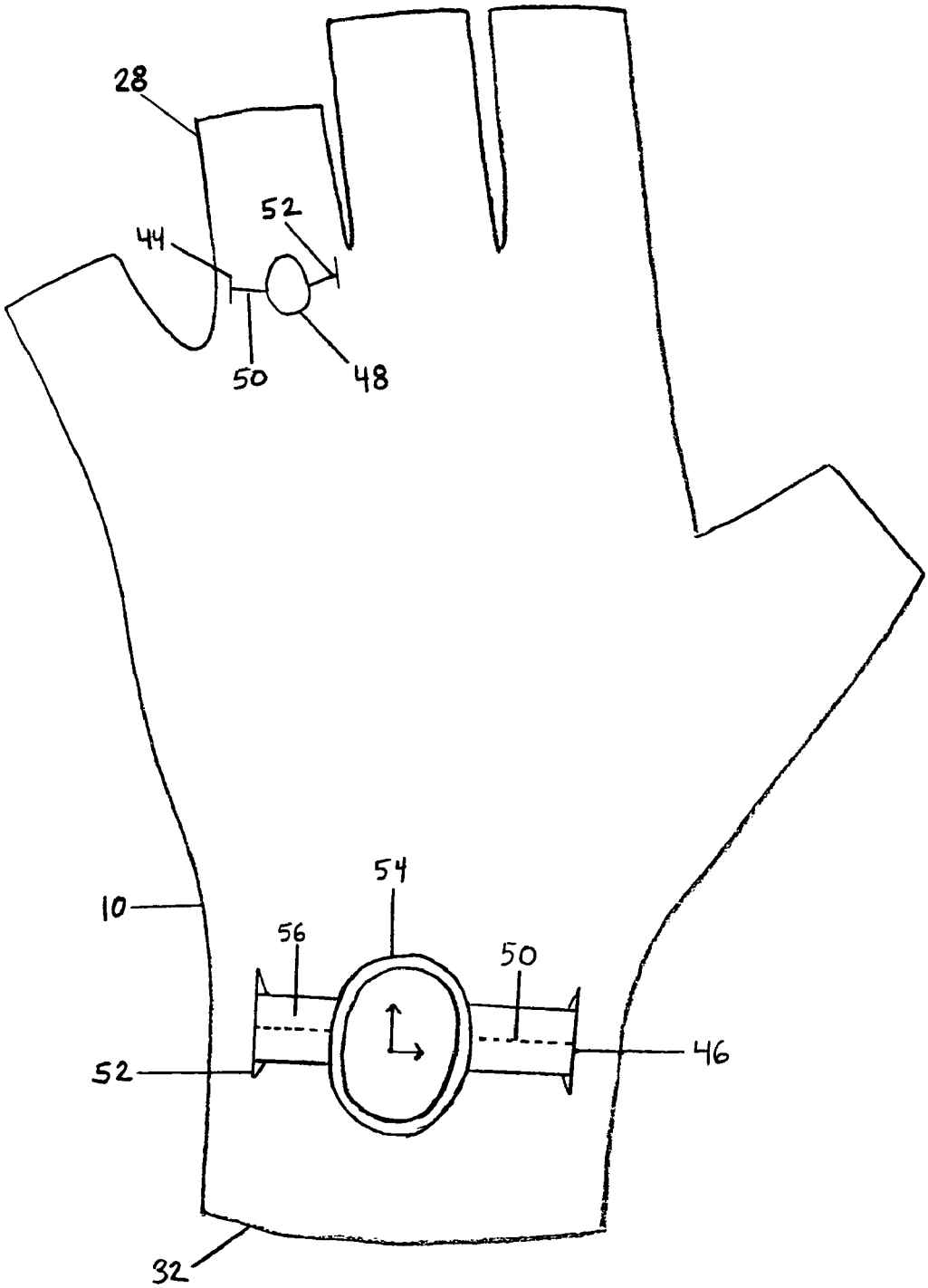
Figure 4B:
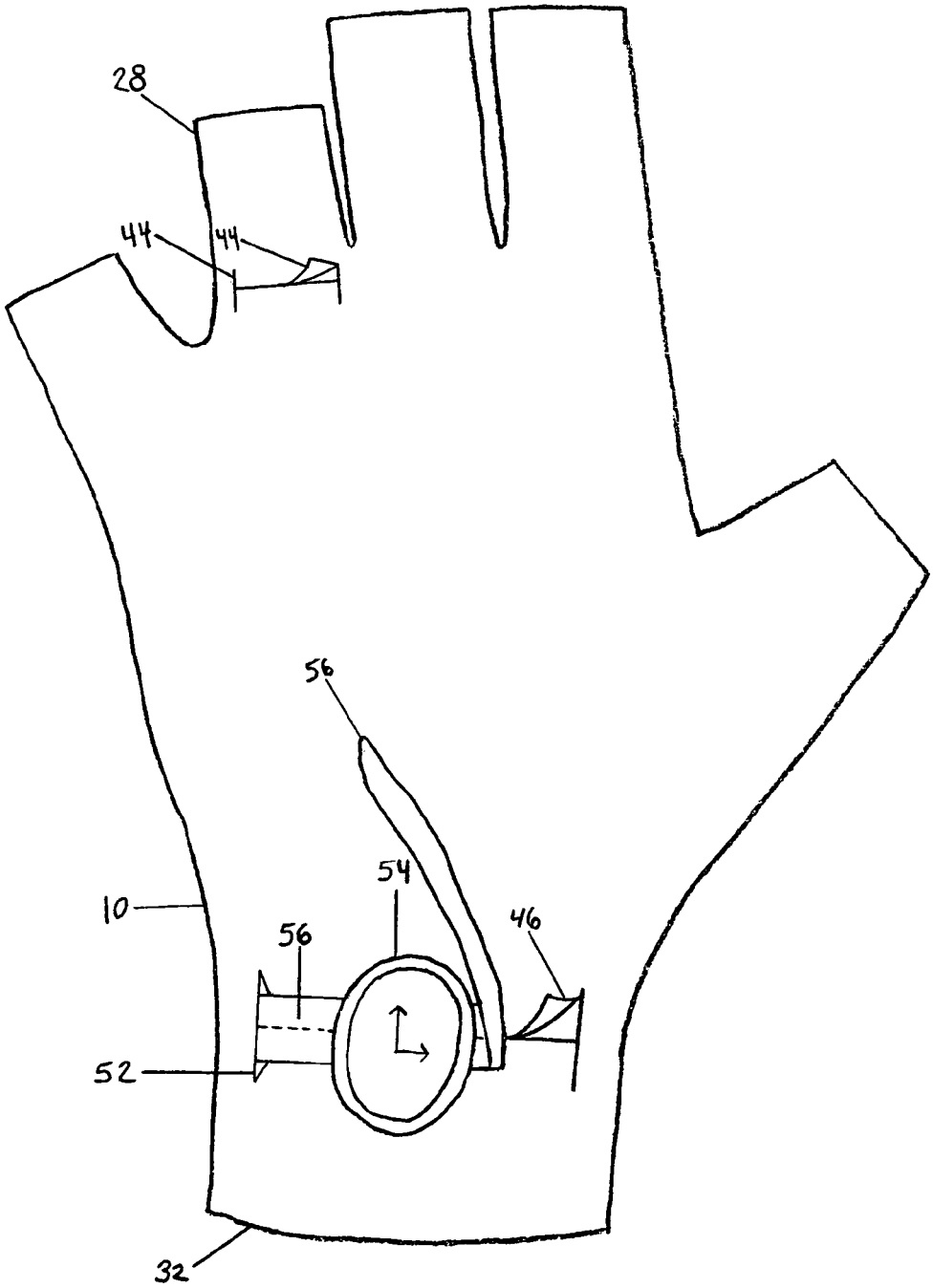

FIG. 1 is a perspective view of a user wearing a pair of adjustable upper extremity gloves FIG. 2A is a perspective view of the adjustable glove with opened sleeve extension FIG. 2B is a cutaway perspective view of the fabric casing sleeve FIG. 3A is a perspective view of the adjustable glove with relaxed drawcord FIG. 3B is a perspective view of the adjustable glove with tightened drawcord FIG. 4A is a top view of the adjustable glove with a slit for a ring and a slit for a watch FIG. 4B is a top view of the adjustable glove with the ring slit and the watch slit flipped back

| DRAWINGS—Reference Numerals | |
|---|---|
| 10 adjustable sun glove | 11 sleeve extension |
| 12 user | 14 upper extremity |
| 16 shoulder | 18 upper arm |
| 20 elbow | 21 forearm |
| 22 wrist | 24 fingers |
| 26 fabric casing pocket | 28 lower portion of glove |
| 30 wrist seam | 32 upper portion of glove |
| 34 VELCRO(hook and loop fastener)strip | 36 relaxed drawcord |
| 38 tightened drawcord | 40 long fabric casing pocket |
| 42 cord lock | 44 slit for ring |
| 46 slit for watch | 48 ring |
| 50 line | 52 perpendicular openings |
| 54 watch | 56 watch wristband |

DETAILED DESCRIPTION—FIGS. 1, 2A, 2B—PREFERRED EMBODIMENT

FIG. 1 is a perspective view of an adjustable sun glove 10 with an opened sleeve extension 11 as worn by a user 12. The adjustable sun glove 10 is worn over the user's 12 upper extremity 14; the upper extremity 14 having a shoulder 16, upper arm 18, elbow 20, forearm 21, wrist 22, and fingers 24. A fabric casing sleeve 26 is empty when the glove 10 is fully opened. The fabric casing pocket 26 is connected to a lower portion of the glove 28 at a wrist seam 30.

FIG. 2A is perspective view of the adjustable glove 10 with an opened sleeve extension 11. The glove 10 has a lower portion 28 and an upper portion 32. The lower portion 28 is worn around the hand while an upper portion 32 extends upward, depending on the length of the sleeve extension 11. The fabric casing pocket 26 is connected to the lower portion of the glove 28 at the wrist seam 30. A VELCRO (hook and loop fastener) strip 34 connects to the fabric casing sleeve 26 with the VELCRO (hook and loop fastener). The fabric casing pocket 26 is empty when the sleeve extension 11 is opened. The empty fabric casing pocket 26 and the VELCRO (hook and loop fastener) strip 34 drape over the sleeve extension 11 when the sleeve extension 11 is open. The sleeve extension 11 may or may not be made of the same fabric as the lower portion of the glove 28. The VELCRO (hook and loop fastener) strip 34 may be placed proximal or distal to the fabric casing pocket 26. In this drawing it is placed proximally.

FIG. 2B is a cutaway perspective view of the fabric casing pocket 26. The upper portion of the glove 32 connects to the sleeve extension 11 at the wrist seam 30. Between the wrist seam 30 and the sleeve extension 11 there is the VELCRO (hook and loop fastener) strip 34. When the sleeve extension 11 is gathered into the fabric casing pocket 26, the VELCRO (hook and loop fastener) strip 34 adheres to itself and holds the gathered sleeve extension 11 in the fabric casing pocket 26. The VELCRO (hook and loop fastener) strip 34 may be placed proximal or distal to the fabric casing pocket 26. In this drawing it is placed distally.

OPERATION—FIGS. 1, 2A, 2B—PREFERRED EMBODIMENT

In use, one of the glove lengths is chosen by the user according to the amount of upper extremity skin they seek to cover. The sleeve extension can be opened to full length and draped over the entire upper extremity to cover the shoulder, upper arm, elbow, forearm, wrist, and hands. Similarly, when the user needs less coverage, the sleeve extension can be gathered into the fabric casing sleeve. The fabric casing sleeve is then secured in the closed position by VELCRO (hook and loop fastener) strip.

DETAILED DESCRIPTION—FIGS. 3A, 3B

FIG. 3A is a perspective view of the adjustable sun glove 10 with a relaxed drawcord 36. The sleeve extension 11 has a drawcord 36 that is mounted within a long fabric casing sleeve 40 and secured by a cord lock 42. The drawcord 36 extends along the entire length of the sleeve extension 11. The lower portion of the glove 28 connects to the sleeve extension 11 at the wrist seam 30 and has no drawcord. The drawcord 36 is made of stretchable elastic or non-stretchable material.

FIG. 3B is a perspective view of the adjustable glove 10 with a tightened drawcord 38. The sleeve extension 11 has a drawcord 38 that is mounted within a long fabric casing sleeve 40 and secured by a cord lock 42. The drawcord 38 extends along the entire length of the sleeve extension. The lower portion of the glove 28 connects to the sleeve extension 11 at the wrist seam 30 and has no drawcord. The sleeve extension fabric 11 is gathered by the tightened drawcord 38.

OPERATION—FIGS. 3A, 3B

In use, one of the adjustable sun glove 10 lengths is chosen by the user according to the amount of upper extremity skin they seek to cover. The sleeve extension 11 can be opened to full length by relaxing the drawcord 36 and then draped over the entire upper extremity to cover the shoulder, upper arm, elbow, forearm, wrist, and fingers. Similarly, when the user needs less coverage, the sleeve extension 11 can be gathered by tightening the drawcord 38. The gathered sleeve extension 11 is then secured in position by the cord lock 42.

DETAILED DESCRIPTION—FIGS. 4A, 4B

FIG. 4A is a top view of the adjustable sun glove 10 with a slit for a ring 44 and a slit for a watch 46. The glove 10 has a lower portion 28 that is worn around the hand and an upper portion 32 that extends upward. The slit for the ring 44 permits a ring 48 to be displayed without compromising skin coverage while the glove 10 is being worn. The shape of the slit for the ring 44 consists of a line 50 with two shorter perpendicular openings 52 at either end. The shape of the slit for the watch 46 is identical, while the lengths are greater. The shape of the slit for the watch 46 consists of a line 50 with two shorter perpendicular openings 52 at either end.

The slit for the watch 46 permits a watch 54 to be displayed without compromising skin coverage while the glove 10 is being worn.

FIG. 4B is a top view of the adjustable sun glove 10 with the ring slit 44 and watch slit 46 flipped back The watch wrist band 56 is flipped up where it inserts into the watch slit 46. The glove 10 has a lower portion 28 that is worn around the hand and an upper portion 32 that extends upward.

OPERATION—FIGS. 4A, 4B

The ring 48 and or watch 54 are kept on the upper extremity while the upper extremity is placed into the glove 10. The watch slit 46 and ring slit permit 44 the watch 54 and/or ring 48 to protrude through the glove 10 fabric while the fabric continues to cover the skin.

What is claimed is:

1. An adjustable sun glove for the upper extremity of a user, comprising:

(a) a sheath of material having a top side and a bottom side an upper portion and a lower portion and an opening at the proximal end adapted to receive said user's upper extremity, (b) a predetermined number of digit sleeves on said lower portion of said sheath, (c) a proximal sleeve extension of predetermined length on said upper portion of said sheath, and;

(d) a means for storing said proximal sleeve extension within said sheath.

2. The adjustable sun glove of claim 1 wherein said storing means is a fabric casing pocket.

3. The fabric casing pocket of claim 2 wherein a hook and loop fastener maintains said fabric casing pocket in a closed position.

4. The adjustable sun glove of claim 1 wherein said proximal sleeve extension includes a drawcord.

5. The adjustable sun glove of claim 1, further including a means for displaying objects.

6. The adjustable sun glove of claim 5 wherein said displaying means is a predetermined number of slits.

7. The slit of claim 6 wherein having a predetermined length.

8. The adjustable sun glove of claim 1, further including a means for enhancing grip.

9. The adjustable sun glove of claim 1, further including a means to removably retain said lower portion from hand.

10. The adjustable sun glove of claim 9 wherein said means to removably retain lower portion of said sheath is a slit of predetermined length.

11. The slit of claim 10 wherein is located at the wrist.

12. The adjustable sun glove of claim 9 wherein removably retained said lower portion can be stored in said fabric casing pocket.

13. A sun shielding device for the upper extremity of a user that has a storable proximal sleeve extension, comprising:

(a) a sheath of material having a top side and a bottom side and an opening at the proximal end adapted to receive user's upper extremity, (b) a predetermined number of digit sleeves on a lower portion of said sheath, (c) a proximal sleeve extension on upper portion of said sheath, said proximal pocket extension and having a predetermined length, (d) a fabric casing sleeve to store said proximal sleeve extension, (e) a predetermined number of slits for displaying jewelry.

* * * * *